US007871500B2

(12) United States Patent
Lah

(10) Patent No.: US 7,871,500 B2
(45) Date of Patent: Jan. 18, 2011

(54) COKE DRUM SKIRT

(75) Inventor: Ruben F. Lah, West Jordan, UT (US)

(73) Assignee: Curtiss-Wright Flow Control Corporation, Falls Church, VA (US)

( * ) Notice: Subject to any disclaimer, the term of this patent is extended or adjusted under 35 U.S.C. 154(b) by 429 days.

(21) Appl. No.: 12/018,468

(22) Filed: Jan. 23, 2008

(65) Prior Publication Data

US 2009/0183980 A1 Jul. 23, 2009

(51) Int. Cl.
*C10B 55/00* (2006.01)
*C10B 29/04* (2006.01)
*C10B 29/08* (2006.01)

(52) U.S. Cl. ..... 202/266; 202/268

(58) Field of Classification Search ..... 202/84, 202/239, 252, 266, 268; 432/251; 196/130
See application file for complete search history.

(56) References Cited

U.S. PATENT DOCUMENTS

| | | | | |
|---|---|---|---|---|
| 176,321 | A | 4/1876 | Kromer | |
| 1,656,355 | A | 1/1928 | Huffmann | |
| 1,991,621 | A | 2/1935 | Noll | |
| 2,064,567 | A | 12/1936 | Riley | |
| 2,245,554 | A | 6/1941 | Court | |
| 2,317,566 | A | 4/1943 | Utterback | |
| 2,403,608 | A | 7/1946 | Payne et al. | |
| 2,562,285 | A | 7/1951 | Timmer | |
| 2,717,865 | A | 9/1955 | Kimberlin, Jr. et al. | |
| 2,734,715 | A | 2/1956 | Knox | |
| 2,761,160 | A | 9/1956 | Manning | |
| 2,858,038 | A * | 10/1958 | Dahm | 220/4.12 |
| 3,215,399 | A | 11/1965 | McInerney et al. | |

(Continued)

FOREIGN PATENT DOCUMENTS

JP 2000145989 5/2000

(Continued)

OTHER PUBLICATIONS

J. J. Kelley, "Applied Artificial Intelligence for Delayed Coking", Hydorcarbon Processing, Nov. 2000, 144-A-144-J, Gulf Publishing Company, USA.

(Continued)

*Primary Examiner*—Jill Warden
*Assistant Examiner*—Joye Woodard
(74) *Attorney, Agent, or Firm*—Kirton & McConkie; Michael F. Krieger

(57) ABSTRACT

A coke drum skirt to minimize the stresses experienced by the coke drum and the supporting structure of the coke drum is described. The skirt includes one circumferential horizontal plate attached to the coke drum, and the circumferential horizontal plate is slidingly sandwiched between a lower supporting plate that supports the weight of the drum through the circumferential horizontal plate and an upper retaining plate that prevents the coke drum from tipping or falling over. The upper retaining plate may be embodied as a series of retaining clips that also keep the coke drum centered and prevent rotation of the coke drum. The upper and lower plates are anchored to a concrete support base. The sliding connection of the plates allows the coke drum to thermally expand and contract while reducing stresses and metal fatigue from the typical fixed securing of the coke drum to the support base.

24 Claims, 4 Drawing Sheets

U.S. PATENT DOCUMENTS 3,246,434 A * 4/1966 Ginder ..... 52/169.1
3,367,625 A 2/1968 Fortune
3,379,623 A 4/1968 Forsyth
3,617,480 A 11/1971 Keel
3,646,947 A 3/1972 Rochelle et al.
3,716,310 A 2/1973 Guenther
3,837,356 A 9/1974 Selep et al.
3,852,047 A 12/1974 Schlinger et al.
4,125,438 A 11/1978 Kelly et al.
4,174,728 A 11/1979 Usnick et al.
4,253,487 A 3/1981 Worley et al.
4,275,842 A 6/1981 Purton et al.
4,335,733 A 6/1982 Richards
4,410,398 A 10/1983 Chipman et al.
RE31,439 E 11/1983 Rosensweig
4,492,103 A 1/1985 Naumann
4,531,539 A 7/1985 Jandrasi
4,611,613 A 9/1986 Kaplan
4,626,320 A 12/1986 Alworth et al.
4,666,585 A 5/1987 Figgins et al.
4,726,109 A 2/1988 Malsbury et al.
4,738,399 A 4/1988 Adams
4,771,805 A 9/1988 Maa
4,797,197 A 1/1989 Mallari
4,824,016 A 4/1989 Cody et al.
4,877,488 A 10/1989 Cody et al.
4,923,021 A 5/1990 Courmier et al.
4,929,339 A 5/1990 Elliott, Jr. et al.
4,960,358 A 10/1990 Digiacomo et al.
4,973,386 A 11/1990 Callegari et al.
4,993,264 A 2/1991 Cody et al.
5,004,152 A 4/1991 Baker et al.
5,022,266 A 6/1991 Cody et al.
5,022,268 A 6/1991 Wolf et al.
5,024,730 A 6/1991 Colvert
5,035,221 A 7/1991 Martin
5,041,207 A 8/1991 Harrington et al.
5,048,876 A 9/1991 Wallskog
5,059,331 A 10/1991 Goyal
5,107,873 A 4/1992 Clinger
5,116,022 A 5/1992 Genreith et al.
5,221,019 A 6/1993 Pechacek et al.
5,228,525 A 7/1993 Denney et al.
5,228,825 A 7/1993 Fruchtbaum et al.
5,299,841 A 4/1994 Schaefer
5,417,811 A 5/1995 Malsbury
5,464,035 A 11/1995 Heinecke
5,581,864 A 12/1996 Rabet
5,633,462 A 5/1997 Heaslip et al.
5,652,145 A 7/1997 Cody et al.
5,785,843 A 7/1998 Antalffy et al.
5,800,680 A 9/1998 Guerra
5,816,505 A 10/1998 Tran et al.
5,816,787 A 10/1998 Brinkerhoff et al.
5,876,568 A 3/1999 Kindersley
5,891,310 A * 4/1999 Nelsen ..... 201/10
5,907,491 A 5/1999 Canada et al.
5,927,684 A 7/1999 Marx et al.
5,947,674 A 9/1999 Malsbury et al.
5,974,887 A 11/1999 Cody et al.
6,007,068 A 12/1999 Dellacorte
6,039,844 A 3/2000 Malik
6,060,015 A * 5/2000 Kågstrom et al. ..... 266/246
6,066,237 A 5/2000 Kindersley
6,113,745 A 9/2000 Maitland et al.
6,117,308 A 9/2000 Gangi
6,223,925 B1 5/2001 Malsbury et al.
6,228,225 B1 5/2001 Meher-Homji
6,254,733 B1 7/2001 Lu et al.
6,264,797 B1 7/2001 Schroeder et al.
6,264,829 B1 7/2001 Antalffy et al.
6,367,843 B1 4/2002 Fetzer
6,539,805 B2 4/2003 Heaslip et al.
6,547,250 B1 4/2003 Noble et al.
6,565,714 B2 5/2003 Lah
6,644,436 B2 11/2003 Hofmann et al.
6,644,567 B1 11/2003 Adams et al.
6,660,131 B2 12/2003 Lah
6,738,697 B2 5/2004 Breed
6,751,852 B2 6/2004 Malsbury et al.
6,843,889 B2 1/2005 Lah
6,926,807 B2 8/2005 Bosi et al.
6,964,727 B2 11/2005 Lah
6,989,081 B2 1/2006 Lah
7,033,460 B2 4/2006 Lah
7,037,408 B2 5/2006 Wilborn et al.
7,115,190 B2 10/2006 Lah
7,117,959 B2 10/2006 Lah
7,316,762 B2 1/2008 Lah
7,666,279 B2 * 2/2010 Cihlar et al. ..... 202/239
2002/0134658 A1 9/2002 Lah
2002/0157897 A1 10/2002 Hoffmann et al.
2002/0166862 A1 11/2002 Malsbury et al.
2002/0170814 A1 11/2002 Lah
2003/0047153 A1 3/2003 Kubel et al.
2003/0089589 A1 5/2003 Malsbury
2003/0127314 A1 7/2003 Bell et al.
2003/0159737 A1 8/2003 Stares
2003/0185718 A1 10/2003 Sellakumar
2004/0118746 A1 6/2004 Wilborn et al.
2004/0154913 A1 8/2004 Lah

FOREIGN PATENT DOCUMENTS

RU 2043604 1 10/1995
RU 2163359 C1 2/2001
SU 558524 3/1984
SU 558524 A 3/1984
SU 959413 3/1984
SU 959413 A 3/1984
WO 0015985 3/2000

OTHER PUBLICATIONS

Claudio Allevato & Richard S. Boswell, "Assessing the Structural Integrity and Remaining Life of Coke Durms with Acoustic Emission Testing, Stain Gaging, and Finite Element Analysis," ETCE 99—Symposium on Plant and Facilities Reliability and Mechanical Integrity, 1999 Engineering Source Technology Conference & Exhibition, Stress Engineering Services, Inc.

Norm Lieberman, "Coke Drum Foam-Overs Causes & Cures," http://www.coking.com/Foamover.htm.

Paul J. Ellis & Christopher A. Paul, "Tutorial: Delayed Coking Fundamentals," AIChE 1998 Spring National Meeting's International Conference on Refinery Processes Topical Conference Preprints 1998, 1998, Great Lakes Carbon Corporation.

* cited by examiner

COKE DRUM SKIRT

BACKGROUND OF THE INVENTION

1. Field of the Invention

The present invention relates to a coke drum mounting and support skirt, and more particularly to a novel support skirt that allows for expansion and contraction of the coke drum during the extreme temperature changes experienced by the coke drum during the delayed coking processes. The described support skirt securely supports the coke drum and prevents tipping of the drum, while allowing thermal contraction and expansion without undue stress to the support or drum.

2. Background and Related Art

Many oil refineries recover valuable products from the heavy residual hydrocarbons (commonly referred to as resid or residuum) that remain following initial refining by a thermal cracking process known as delayed coking. The processing of crude oil into gasoline, diesel fuel, lubricants, and the like, as well as many other petroleum-refining operations, produces byproducts that have very little value. However, the value of these byproducts can be substantially increased when they are heated for a long enough time at a temperature sufficient to cause "destructive distillation." During the process of destructive distillation, a portion of the byproducts is converted to usable hydrocarbon products. The remainder is transformed into a solid carbon product called coke. In the refining industry, this process is commonly known as delayed coking.

Generally, the delayed coking process involves heating the heavy hydrocarbon feed from a fractionation unit, then pumping the heated heavy feed into a large steel vessel commonly known as a coke drum. The unvaporized portion of the heated heavy feed settles out in the coke vessel where the combined effect of retention time and temperature causes the formation of coke. Vapors from the top of the coke vessel, which typically consist of steam, gas, naphtha and gas oils, are returned to the base of the fractionation unit for further processing into desired light hydrocarbon products. The operating conditions of delayed coking can be quite severe. Normal operating pressures in coke vessels typically range from 25 to about 50 pounds per square inch and the heavy feed input temperature may vary between 800 degrees Fahrenheit and 1000 degrees Fahrenheit.

Coke drums are typically large, cylindrical vessels commonly 19 to 30 feet in diameter and up to 120 feet tall having a top head and a funnel shaped bottom portion fitted with a bottom head and are usually present in pairs so that they can be operated alternately. The size, shape, and configuration of the coke drum may vary considerably from one installation to another. Coke is formed and accumulates in the vessel until it is filled to a safe margin, at which time the heated feed is switched to the empty "sister" coke vessel. This use of multiple coke drums enables the refinery to operate the fired heater and fractionation tower continuously. Thus, while one coke vessel is being filled with heated residual oil, the other vessel is being cooled and purged of coke (between 500 and 1200 tons) formed in the vessel during the previous recovery cycle. The full vessel is isolated, steamed to remove hydrocarbon vapors, cooled by filling with water, drained, opened, and the coke is removed. The drums typically operate on a cycle, switching every 10 to 30 hours.

Coke removal, also known as decoking, begins with a quench step in which steam and then water are introduced into the coke-filled vessel to complete the recovery of volatile, light hydrocarbons and to cool the mass of coke. The vessel is then drained and vented to atmospheric pressure then opened (unheaded or deheaded) in preparation for decoking. Decoking is accomplished at most plants using a hydraulic system consisting of a drill stem and drill bit that direct high pressure water jets into the coke bed. This cuts the coke into small pieces which fall out the opened bottom of the coke drum. Once it is decoked, the drum is closed (re-headed), purged of air, leak tested, warmed-up, and placed on stand-by, ready to repeat the 10- to 30-hour cycle.

The coke drums are largely vertical, with heights from three to four times their diameters to facilitate the delayed coking process and the decoking process. This large height/diameter ratio makes the coking drums susceptible to tipping due to forces such as those from strong winds. Further compounding this problem, the coke drums must be elevated to some extent to allow room underneath the coke drums for the dislodged coke to fall out and be removed during the decoking process. This increases the susceptibility of the coke drums to winds and other forces.

The coke drums must be secured against these forces. A typical coke drum is supported by a skirt which is welded to the drum near the junction of the drum shell and the lower cone of the drum. The skirt of the coke drum is then typically placed on a reinforced cylindrical or quasi-cylindrical hollow concrete base that provides support for the drum. This is necessary due to the extreme weight of a filled steel coke drum containing as much as 1200 tons of coke and built to withstand over 50 pounds per square inch of pressure at 900 degrees Fahrenheit. The coke drum's skirt is typically bolted to the concrete base with heavy bolts along the base of the skirt.

This is problematic, however, for the cyclical coking/decoking process subjects the large and heavy coke drums to frequent temperature fluctuations of hundreds of degrees. The temperatures fluctuate from the decoking temperature which may approach environmental conditions of 100 to 200 degrees Fahrenheit to the operating temperature around or above 900 degrees Fahrenheit. The steel drums, of course, expand and contract as a result of the temperature changes, and this expansion and contraction can be quite severe. For example, an unsecured thirty-foot-diameter steel coke drum may increase in diameter as much as two to two and one-half inches during the 700-800-degree-Fahrenheit temperature change it experiences during delayed coking and decoking.

The typical coke drum, however, is not unsecured, but is securely bolted at its base to prevent tipping. The typical bolting process severely restricts the range of expansion within which the base of the coke drum can expand. This fixed securing structure results in large forces and stresses at the base of the coke drum. The bolts securing the skirt to the concrete base may be subjected to large shear stresses as the coke drum attempts to expand, which may eventually result in failure of the bolts. In addition, the joining of the skirt to the coke drum also undergoes large stresses and is subject to failure, which may lead to rupture of the shell of the coke drum. In addition, the concrete in which the bolts are embedded may crack and fail due to the stresses incurred. Finally, another potential hazard exists. The failure of the system securing the coke drum to the concrete base may be slow and almost invisible, resulting in a gradual weakening of the support system. While the support system might appear to be fine externally, the weakened support system may no longer be able to support the drum in high winds or other lateral forces, leading to sudden, unexpected, and catastrophic failure.

BRIEF SUMMARY OF THE INVENTION

A novel coke drum skirt provides a secure connection between a coke drum and a support base while simultaneously providing for reduced-stress thermal expansion and contraction of the coke drum during operation of the coke drum during the delayed coking/decoking processes. The connection that provides for the reduced-stress thermal expansion and contraction is a horizontally-sliding floating connection between the coke drum and the fixed and anchored support structure for the coke drum.

This is achieved by providing for a three-layer sandwich of metal plates surrounding the coke drum. A substantially-horizontal center plate may be attached to either the coke drum or the fixed support structure for the coke drum, so long as corresponding top and bottom plates are attached to the opposite structure: if the center plate is attached to the coke drum, the top and bottom plates are attached to the fixed support structure; if the center plate is attached to the support structure, the top and bottom plates are attached to the coke drum. When the center plate is attached to the coke drum, the bottom plate provides weight-bearing support for the center plate, which rests on, but is not attached to, the bottom plate. The top plate is attached to the bottom plate and rests over the center plate, preventing the coke drum from tipping over due to external forces from wind, earthquake, or any other lateral tipping force. Because the center plate rests between the top and bottom plates, the center plate may expand and contract with the coke drum during thermal expansion and contraction, sliding over and under the top and bottom plates, respectively, as needed.

The space between the bottom and top plates may be provided by a spacer that may be slightly thicker than the thickness of the center plate. In some embodiments, the bottom plate, the center plate, the spacer, and the top plate may each be single plates that completely encircle the coke drum. In other embodiments, the top plate is replaced by a series of retaining clips that serve as a top plate to retain the coke drum from tipping. In other embodiments, the center plate may be provided as a series of individual plates to provide for further reducing the stresses on the coke drum during thermal expansion and contraction.

To provide additional support to the center plate, which bears nearly the full weight of the coke drum, the center plate may be provided with a series of struts and pads attached to and extending between the center plate and the coke drum. This distributes the weight and connection between the coke drum and the center plate for maximal support. In embodiments containing the struts and retaining clips, the struts and retaining clips may engage and interact to ensure that the coke drum remains centered in the coke drum skirt support structure and to brace against rotational forces that might transfer stresses to the feed lines or other structures attached to the coke drum. In some embodiments, the lower plate may be elevated above the supporting base by a support structure, while in other embodiments the lower plate may be secured directly to the supporting base, which supporting base is typically concrete.

Thus a horizontally-sliding connection is provided between the fixed and anchored support base and the floating coke drum. As the coke drum heats and expands during the delayed coking process, the center plate slides over the bottom plate and top plate within the space defined by the bottom plate, the top plate (or retaining clips) and the spacer, and fewer forces are transferred to the coke drum, the support structure, and any mounting hardware. As the coke drum cools during the quenching and decoking processes, the center plate slides inwardly as the coke drum contracts, yet the center plate still remains over the bottom plate sufficiently to provide continued support for the coke drum, and no large lateral forces are transferred between the coke drum and the support structure.

The sliding motion may be facilitated by providing low-friction surfaces on the top surface of the bottom plate, on the bottom surface of the top plate or retaining clips and on the bottom and top surfaces of the center plate. The top surface of the bottom plate and the bottom surface of the center plate are most important to provide with a low-friction surface since these are the weight-bearing surfaces of the coke drum skirt. The low-friction surfaces may be provided by attaching a low-friction material to the surfaces or by grinding or polishing the surfaces.

BRIEF DESCRIPTION OF THE SEVERAL VIEWS OF THE DRAWINGS

The objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

Referring now to the Figures, a description of the embodiments of the present invention will be given. It is expected that the present invention may take many other forms and shapes, hence the following disclosure is intended to be illustrative and not limiting, and the scope of the invention should be determined by reference to the appended claims.

The inventive coke drum skirt described herein provides for thermal expansion and contraction of the coke drum during the delayed coking and decoking processes by providing for a sliding secure connection between the coke drum and the skirt. This connection is provided by sandwiching one circular plate of metal that encircles the coke drum or by sandwiching a series of metal plates encircling the coke drum between two other circular plates of metal encircling the coke drum or between a circular plate of metal and a series of retaining clips that approximate a second circular plate of metal. The two sandwiching circular plates of metal or the circular plate of metal and retaining clips are attached to the supporting base if the sandwiched plate of metal is attached to the coke drum. Conversely, if the sandwiched plate of metal is attached to the supporting base, the other circular plate of metals or retaining clips are attached to the coke drum. The sandwiched plate or plates is not attached to the sandwiching plates or retaining clips.

The various plates of metal or retaining clips are provided with low-friction surfaces that allow the coke drum to expand and contract as the various plates or clips slide past one another, greatly reducing the stresses incurred on the coke drum and support mechanism from the thermal expansion and contraction. The low-friction surface may be provided by coating the surface of the plates with a low-friction material, or it may be provided by grinding or polishing the surface of the plates to achieve as smooth a surface as desired or as possible. Regardless of the extent of thermal expansion or contraction, the sandwiched plate remains sandwiched: the coke drum is securely supported at all times and is secured against tipping forces that would otherwise rotate the coke drum away from its vertical operating configuration or cause it to fall.

Figure 1:
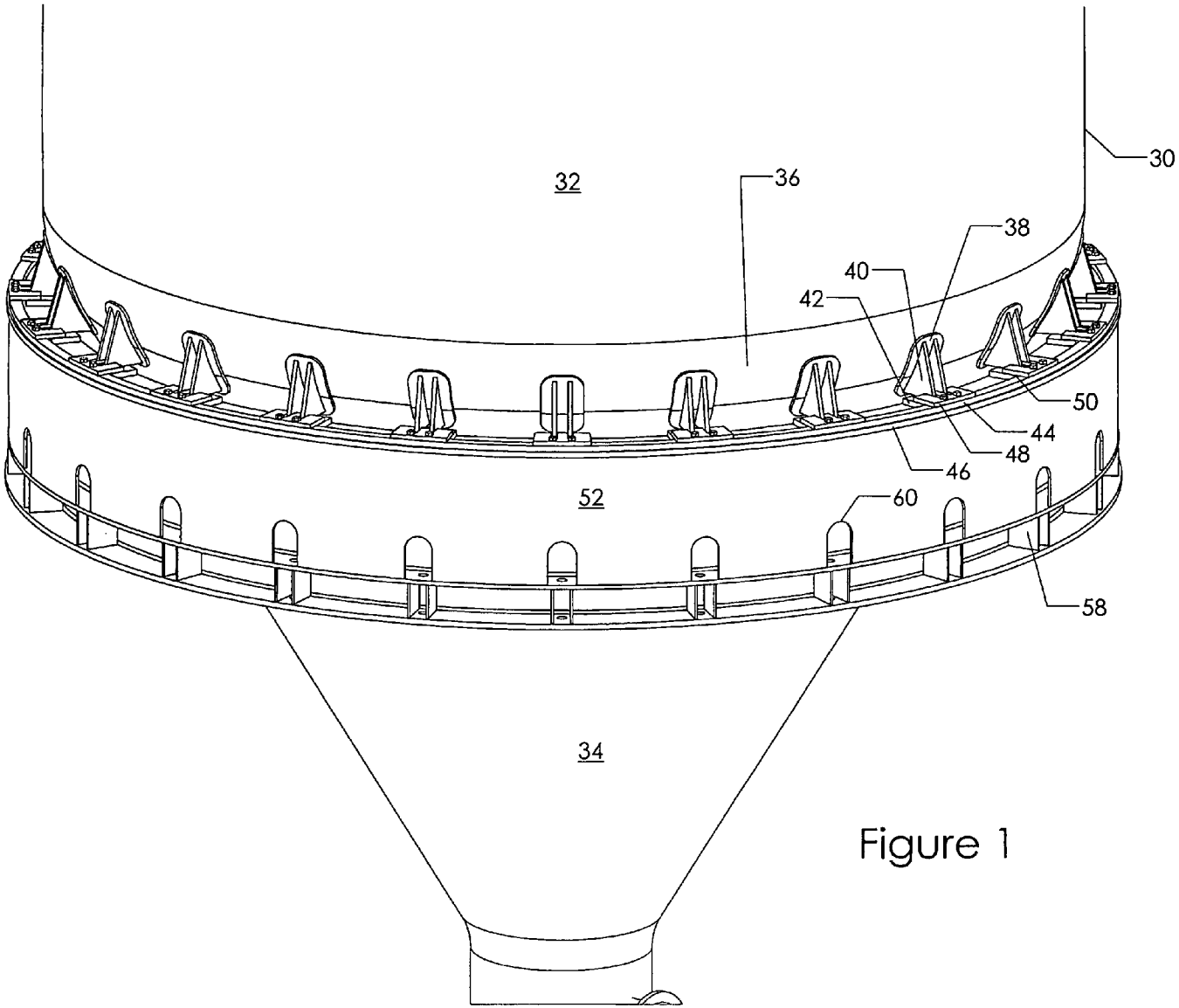
FIG. 1 shows a perspective view of one embodiment of a coke drum skirt.

A representative embodiment with the sandwiched plate secured to the coke drum will now be described. FIG. 1 shows a coke drum 30 of the type used for delayed coking. The coke drum 30 has an upper portion 32 that is substantially cylindrical and a lower portion 34 that is roughly conical. The coke drum 30 also has a shoulder 36 joining the upper portion 32 and the lower portion 34. Attached to the shoulder 36 are a series of pads 38 symmetrically arranged around the diameter of the coke drum 30 at the shoulder 34. The pads 38 may be attached to the coke drum 30 by any means known in the art for such joining where large weights will be supported, including welding, spot welding, strong gluing, riveting, bolting or any other such method known now or later invented. The pads 38 may also be integrally formed as part of the coke drum 30 or may optionally be omitted in other embodiments.

Each pad 38 has a pair of vertical struts 40 that provide support to a sandwiched plate 42 that extends substantially horizontally from the shoulder 36, completely encircling the coke drum 30. The vertical struts 40 and sandwiched plate 42 may be joined to the pads 38 and/or coke drum 30 by any means known in the art, as described above, or may optionally be integrally formed with the pads 38 in any combination, i.e. the sandwiched plate 42 may be integrally formed with the struts 40 and pads 38 and the pads 38 then attached to the coke drum 30, or the struts 40 and pads 38 may be integrally formed and attached to the sandwiched plate 42 and the coke drum 30, etc. Although the sandwiched plate 42 is shown as being separated into individual plates associated with one or several pads 38, with several such individual sandwiched plates encircling the coke drum 30 to provide support, it is anticipated that the sandwiched plate may be a continuous sandwiched plate 42*a*, such that the contiguous plate completely encircles the coke drum 30.

The sandwiched plate 42 is "sandwiched" because it is located between two other plates, which two other plates are separated by a spacer 44. The spacer 44 may be slightly thicker than the sandwiched plate 42 so as to provide a minimal amount of vertical play in the location of the sandwiched plate 42 to provide less friction as the sandwiched plate moves with the coke drum's 30 expansion and contraction during the delayed coking/decoking process. The spacer 44 has a smaller radial thickness than do the plates it separates, which will become apparent below. Below the spacer 44 is a lower plate 46 on which the sandwiched plate 42 rests and which supports the weight of the coke drum 32 through the sandwiched plate 42, struts 40, and pads 38. Above the spacer 44 is an upper plate 48 shown as a retaining clip (hereafter referred to as "retaining clip 48," when referring to the specific embodiment displayed in FIGS. 1-3 and as "upper plate 48" when referring to the embodiment displayed in FIG. 4).

The retaining clip 48 in the embodiment shown in FIG. 1 does not support the weight of the coke drum 30 but rather retains the coke drum 30 against tipping or other similar forces against the coke drum 30 due to winds, earthquakes, or other events that would otherwise cause the coke drum 30 to tip or fall over. In the event such a force is encountered that is strong enough to overcome the coke drum's 30 weight, the coke drum 30 will shift a very slight amount corresponding to the difference in thickness of the sandwiched plate 42 and the spacer 44, until the upper surface of the sandwiched plate 42 engages the lower surface of the retaining clips 48. At that point, the retaining clips 48 prevent further tipping motion of the coke drum 30 until the tipping force passes and the coke drum 30 settles back into its resting position. In part because the retaining clips 48 do not typically experience large forces, the retaining clips 48 need not completely enclose every point on the sandwiched plate 42, but may placed to selectively engage certain points surrounding the coke drum 30 instead, as is depicted in FIG. 1. As may be appreciated by reference to FIG. 1, the illustrated embodiment of the retaining clips 48 are approximately shaped like a capital "E" so as to slidingly engage the struts 40. This provides the additional benefits of providing some support against rotational forces that might cause stress to or breakage of attached feed lines and other structures attached to the coke drum 30 and keeping the coke drum 30 centered on the support structure.

The retaining clips 48 may be attached to spacer 44 and lower plate 46 by any means commonly known in the art, as described above in reference to the pads 38. It may be desirous to use a method of reversible attachment such as bolting in some instances to allow easy replacement of damaged or stressed retaining clips. The lower surface of the retaining clips 48, the upper surface of the lower plate 46, and the lower and upper surfaces of the sandwiched plate 42 are desirably manufactured to have a low coefficient of friction. This allows the sandwiched plate 42 to easily slide in and out as the coke drum 30 expands and contracts during the delayed coking and decoking processes. The interaction between the various plates may be appreciated further by reference to FIGS. 2 and 3.

Figure 2:
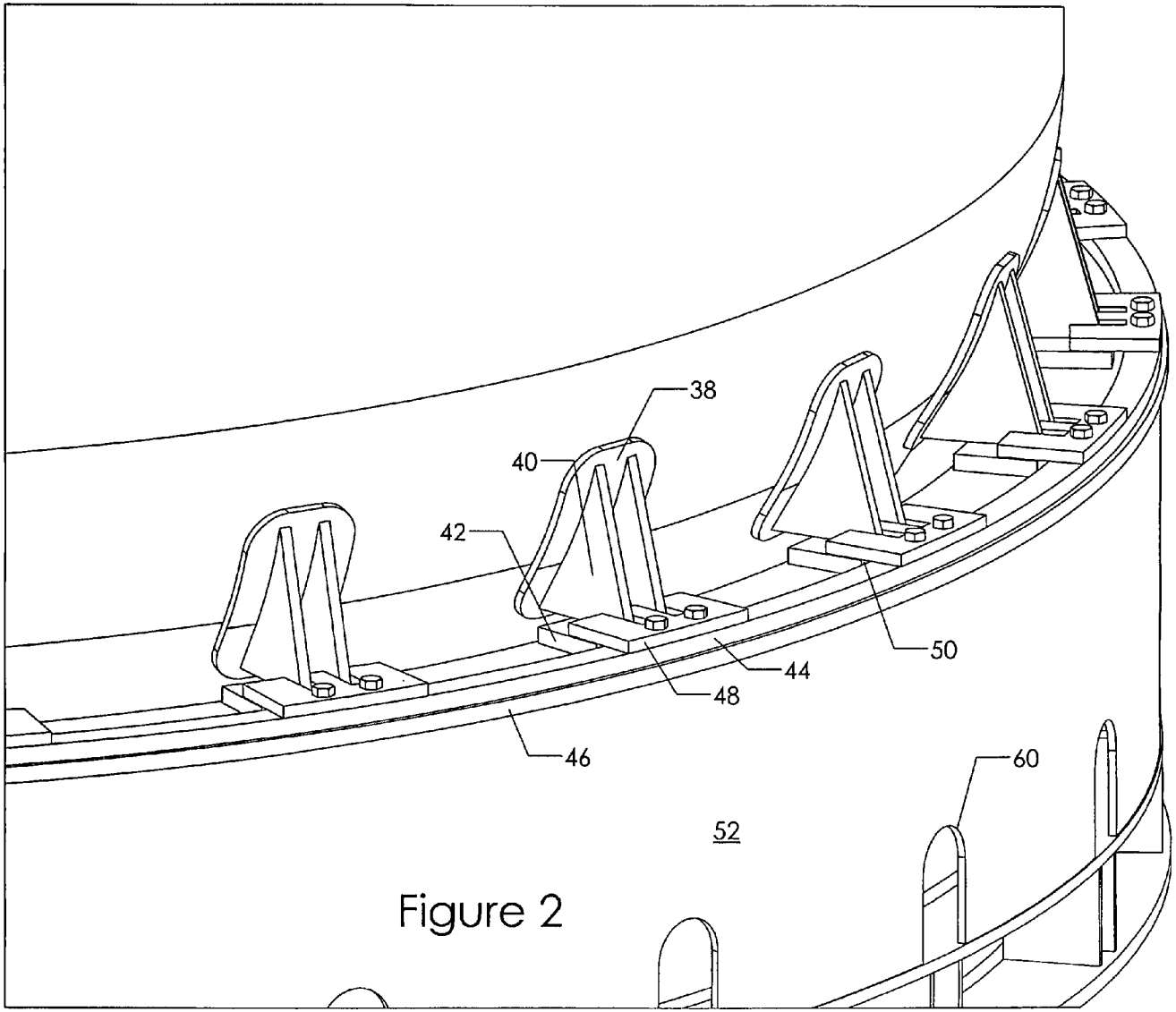
FIG. 2 shows a closer perspective view of one feature of the embodiment of a coke drum skirt of FIG. 1.

FIG. 2 shows a more-detailed close-up perspective view of the interaction of the various plates. As may be appreciated from the foregoing description and from reference to FIG. 2, a radial expansion space 50 is defined by the outer edge of the sandwiched plate 42 and the inner edge of the spacer 44 to allow for proper expansion and contraction of the coke drum 30. As the coke drum 30 heats and expands, the radial expansion space 50 decreases in size. Conversely, during cooling of the coke drum 30, the coke drum 30 contracts, the sandwiched plate 42 moves away from the spacer 44 and the radial expansion space 50 increases in size. To allow for full expansion of the coke drum 30 and attached structures, the inner diameter of the spacer 44 (when measured across the widest diameter of the coke drum 30) should be chosen so as to be no less than the maximum expected expanded diameter of the coke drum 30.

Figure 3:
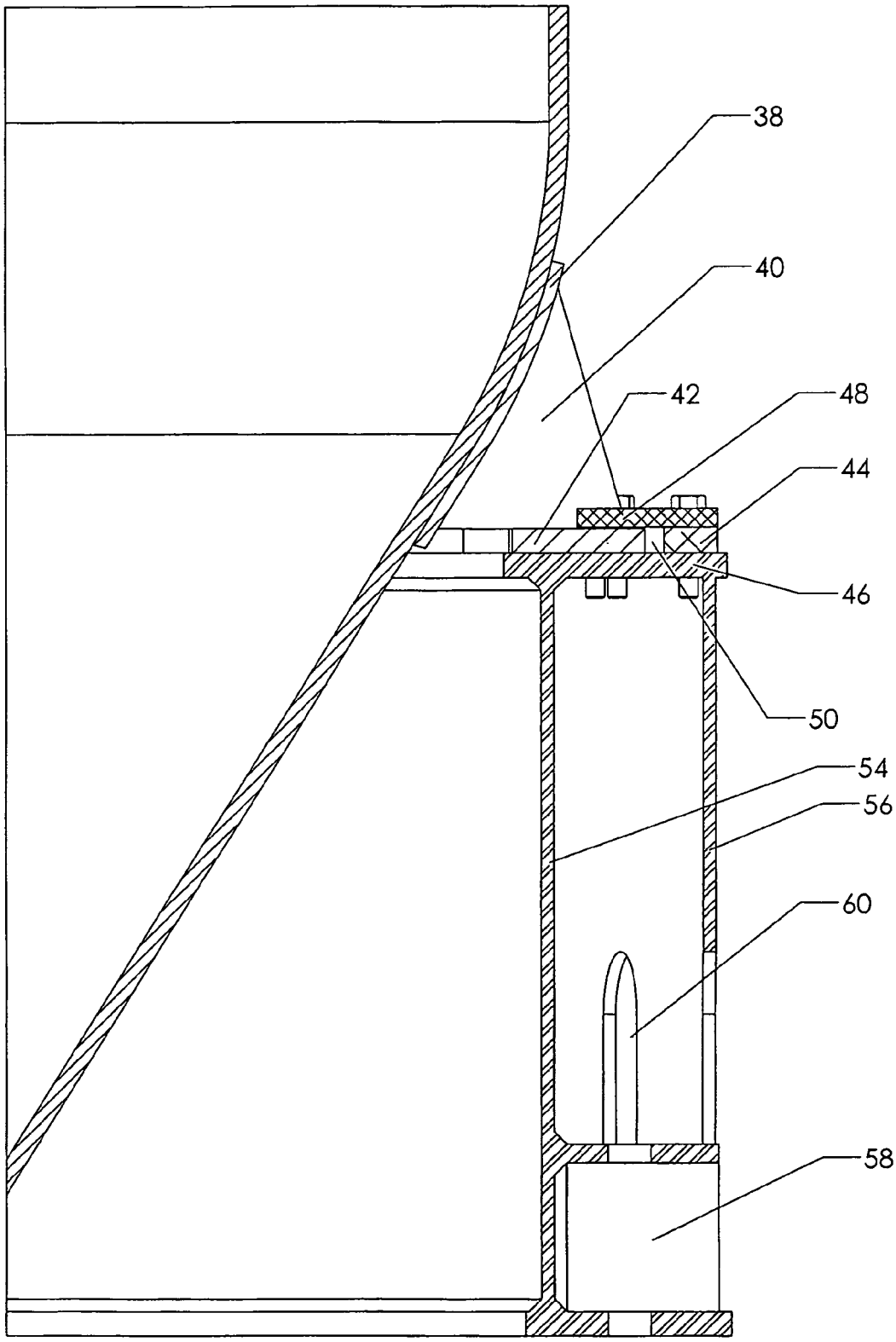
FIG. 3 shows a sectional view of the embodiment of a coke drum skirt from FIG. 1.

FIG. 3 shows a cross-sectional view of the embodiment of the coke drum skirt shown in FIGS. 1 and 2, taken through the middle prong of one of the E-shaped retaining clips 48 shown in those Figures. As may be readily appreciated, as the coke drum skirt is essentially radially symmetrical, the cross section from FIG. 3 is similar to the cross section taken at any one of the retaining clips 48 shown in FIGS. 1 and 2. It is anticipated, however, that an asymmetrical coke drum skirt would provide the same functionality. FIG. 3 illustrates how the lower plate 46 and sandwiched plate 42 provide support for the coke drum 30. The sandwiched plate 42 extends over the lower plate 46 sufficiently so that even in when the coke drum 30 is in its maximally-contracted state, or even when the coke drum 30 is not in use and is at an environmental temperature, the sandwiched plate 42 still rests on the lower plate 46 and provides support for the coke drum 30. The support is transferred through the struts 40 to the pads 38, and thus to the coke drum 30.

From the Figures, it may be recognized that the struts 40 provide an additional function besides transferring the support of the lower plate 46 to the coke drum 30. Because the struts 40 are interlaced with the arms of the retaining clips 48, the struts 40 prevent two potentially-troublesome occurrences. First, as mentioned above, the struts 40 prevent rotational forces from being transferred to feed lines and other structures on the coke drum 30. Additionally, the struts 40 and interlacing arms of the retaining clips 48 also keep the coke drum 30 centered on lower plate 46 where the support for the coke drum 30 is strongest. Thus, the coke drum 30 will not slide laterally until it is unsupported on one side and prone to tipping due to its large weight. Optionally, the sandwiched plate 42 and lower plate 46 may be sized so as to prevent such tipping even if the coke drum 30 were to slide laterally to a maximal extent. This type of sizing is particularly helpful in embodiments where the struts 40 are omitted.

The embodiment of the coke drum skirt depicted in FIGS. 1-3 also includes additional structure linking the lower plate 46, spacer 44, and retaining clips 48 to the concrete supporting pad (not shown). While it is envisioned that in some embodiments the lower plate 46, spacer 44, and retaining clips 48 may be directly mounted to the concrete supporting pad, other embodiments include an additional elevated supporting structure such as that shown in the Figures. The supporting structure shown includes a riser 52 formed from an inner plate 54 and an outer plate 56. The riser 52 supports the lower plate 46 and rests on and is attached to a mounting structure 58. The mounting structure 58 may be bolted to the concrete supporting pad (not shown) and the bolting may be facilitated by access holes 60 placed in the outer plate 56 over the locations where the bolts are to be used. Optionally, another mounting method other than bolting may be used, as long as it secures the coke drum skirt to the supporting pad.

One method by which the coke drum skirt may be provided and mounted will be described now. The site where the coke drum 30 will be placed is prepared to receive the coke drum skirt. The elevated supporting structure may then be placed on the site and firmly attached to the concrete support base, whether it be a pad, tube, or other structure that facilitates the delayed coking/decoking process. The elevated supporting structure at this point may include the lower plate 46 and spacer 44, but it does not include the retaining clips 48 as they would interfere with the placement of the coke drum 30 on the supporting structure of the coke drum skirt. The coke drum 30 is prepared by attaching the pads 38, struts 40 and sandwiched plate 42, as described above. Then, the coke drum is lifted up and vertically lowered into the supporting structure until the sandwiched plate 42 rests on the lower plate 46 of the supporting structure and approximately centered within the spacer 44.

The retaining clips 48 may then be mounted to retain the coke drum by any means known in the art as described above. As this takes place, the coke drum 30 may continue to be supported by whatever method was used to lift the coke drum 30 in place, which may allow the coke drum 30 to be shifted laterally as the retaining clips 48 are mounted to properly align the coke drum 30. The feed lines and other structures that need to be mounted on the coke drum 30 may then be mounted and operation of the coke drum 30 may begin. The retaining clips 48 may be removed if necessary for repairs or if the coke drum 30 is to be removed completely for any reason.

Alternatively, the process illustrated above may occur in a different order. Rather than mount the coke drum skirt supporting structure to the concrete supporting structure and then lift the coke drum 30 in place, the entire structure depicted in FIGS. 1-3 may be mounted to the coke drum 30 while the coke drum 30 is not in place (such as with the coke drum in a horizontal position on its side). Then, the coke drum 30 and the entire structure may be lifted into place and the supporting structure discussed above merely bolted to the concrete support structure or pad through the mounting structure 58, as described above.

If the coke drum skirt is to be used with an existing installation, it may be less than practical or desirable to completely remove the coke drum 30, lower it to its side, and proceed as above. In such a situation, it may be desirous and advantageous to simply lift the coke drum 30 from its operating location, remove the old coke drum skirt or support structure, place the entire supporting structure depicted in the Figures underneath the coke drum 30, whether assembled in place or placed after fully assembled, and then lower the coke drum 30 into the new coke drum skirt. The pads 38, struts 40, and sandwiched plate 42 could then be attached to the coke drum 30 and operation resumed. Thus it may be understood that the illustrated coke drum skirt is flexible in its installation and ability to be retrofitted to old installations.

Although the illustrated embodiment discussed above shows the coke drum skirt located at approximately the shoulder 36 of the coke drum 30, it may be readily appreciated that the coke drum skirt may be located at other vertical locations of the coke drum 30 as desired without affecting its function of supporting the coke drum. Other changes may also be made and still come within the meaning and range of equivalency of the claims below. For example, as discussed above, the various plates forming the sandwich of plates may be continuous or may be divided into discrete elements. For example, the sandwiched plate 42, the lower plate 46 and the spacer 44, which are illustrated in FIG. 1 as all being continuous plates forming a circle around the coke drum 30, may be divided into smaller individual sections if desired to improve ease of attachment or to provide reduced stresses during expansion and contraction of the coke drum 30. The sandwiched plate 42, particularly, may be divided into individual sections corresponding to single pads 38, two pads 38, or any number of pads 38.

Although the illustrated embodiment is shown as being largely circularly symmetrical, it is envisioned that the coke drum skirt and/or its individual structures may be asymmetrical or only partially symmetrical without affecting its primary purpose. In addition, the exact number of supporting structures (pads 38 and struts 40) encircling the coke drum 30 is not deemed important as long as the coke drum 30 is provided with sufficient support and retention. Indeed, it is envisioned that the pads 38 and struts 40 may be eliminated in some embodiments and that different structures may be used to provide linking support from the coke drum 30 to the sandwiched plate 42. In some embodiments, a sandwiched plate 42 may be provided that either has a bend in it that conforms to the coke drum 30, or a sandwiched plate 42 may be provided that is sufficiently strong, in and of itself, to not require any additional supporting structure attached to the coke drum 30.

Figure 4:
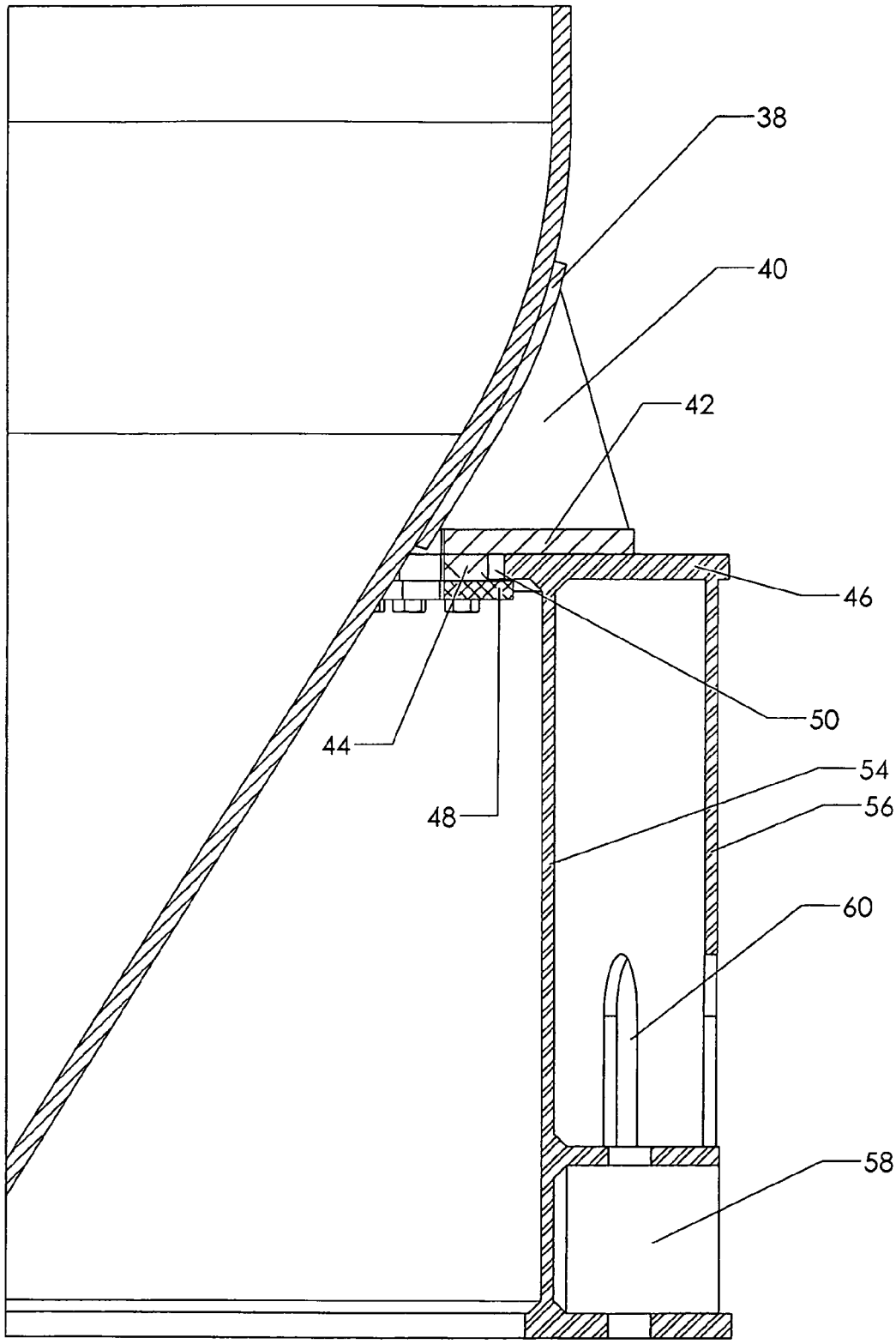
FIG. 4 shows a sectional view of an alternate embodiment of a coke drum skirt.

FIG. 4 shows an alternate embodiment of the coke drum skirt. In the embodiment depicted in FIG. 4, the sandwiched plate 42 is mounted to the supporting structure rather than to the coke drum 30. This means that the upper plate 48, spacer 44, and lower plate 46 are mounted to the coke drum 30. In this embodiment, the weight-supporting interaction occurs between the upper plate 48 and sandwiched plate 42, while the lower plate 46 provides the function provided by the retaining clips 48 in the embodiment illustrated in FIGS. 1-3. The primary sliding functionality of the coke drum skirt is maintained, and the embodiment of FIG. 4 illustrates another way in which the invention may be modified and still maintain its primary functionality.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A coke drum skirt that provides a secure connection between a coke drum and a support base while simultaneously providing for reduced-stress thermal expansion and contraction of the coke drum comprising:

a coke drum;

a support structure for the coke drum attached to a support base;

a substantially-horizontal center plate with an upper surface and a lower surface, wherein the center plate is attached to the coke drum;

a lower plate having a substantially-horizontal upper surface, the lower plate being attached to the support structure; and an upper plate having a substantially-horizontal lower surface, the upper plate being attached to the support structure, wherein the lower surface of the upper plate is separated from the upper surface of the lower plate, wherein the center plate is structured to be located in the space defined between the upper surface of the lower plate and the lower surface of the upper plate so as to slidingly engage the lower plate and upper plate.

2. A coke drum skirt as in claim 1, wherein the upper surface and the lower surface of the center plate have a low coefficient of friction.

3. A coke drum skirt as in claim 1, wherein the upper surface of the lower plate comprises a low coefficient of friction.

4. A coke drum skirt as in claim 1, wherein the lower surface of the upper plate comprises a low coefficient of friction.

5. A coke drum skirt as in claim 1, further comprising a spacer attached between the lower plate and the upper plate with a thickness corresponding to the separation between the upper surface of the lower plate and the lower surface of the upper plate.

6. A coke drum skirt as in claim 5, wherein the spacer is connected to the support structure by being attached to the upper surface of the lower plate and the upper plate is connected to the support structure by being attached to the spacer so that the lower plate, the spacer, and the upper plate form a sandwich.

7. A coke drum skirt as in claim 6, further comprising a support pad attached to the coke drum and connected to the center plate by a strut.

8. A coke drum skirt as in claim 1, wherein the upper plate is a retaining clip.

9. A coke drum skirt as in claim 1, wherein the upper plate comprises a series of retaining clips.

10. A coke drum skirt as in claim 1, wherein the center plate is a single plate that completely encircles the coke drum.

11. A coke drum skirt as in claim 1, wherein the lower plate is a single plate that completely encircles the coke drum.

12. A coke drum skirt as in claim 1, wherein the coke drum skirt is attached to the coke drum near a junction in the coke drum between an upper substantially-cylindrical portion and a lower substantially-conical portion.

13. A coke drum skirt as in claim 1, wherein the support structure for the coke drum comprises an elevated riser attached to a mounting structure that is securely mounted to the support base.

14. A coke drum skirt as in claim 1, wherein the center plate is coupled to the coke drum and the lower plate and upper plate are attached to the support structure by a method selected from the group comprising of bolting, welding, spot welding, riveting, cementing, and gluing.

15. A coke drum skirt that provides a secure connection between a coke drum and a support base while simultaneously providing for reduced-stress thermal expansion and contraction of the coke drum comprising:

a coke drum;

a support structure for the coke drum attached to a support base;

a substantially-horizontal center plate with an upper surface and a lower surface, wherein the center plate is attached to the support structure;

a lower plate having a substantially-horizontal upper surface, the lower plate being attached to the coke drum; and an upper plate having a substantially-horizontal lower surface, the upper plate being attached to the coke drum, wherein the lower surface of the upper plate is separated from the upper surface of the lower plate, wherein the center plate is structured to be located in the space defined between the upper surface of the lower plate and the lower surface of the upper plate so as to slidingly engage the lower plate and upper plate.

16. The coke drum skirt of claim 15, wherein the upper surface and the lower surface of the center plate have a low coefficient of friction.

17. The coke drum skirt of claim 15, wherein the upper surface of the lower plate comprises a low coefficient of friction.

18. The coke drum skirt of claim 15, wherein the lower surface of the upper plate comprises a low coefficient of friction.

19. The coke drum skirt of claim 15, wherein the lower plate and the center plate are single plates that completely encircle the coke drum, further comprising a spacer slightly thicker than the center plate attached to the support structure between the lower plate and the upper plate.

20. The coke drum skirt of claim 15, wherein the upper plate is a retaining clip, further comprising a pad attached to the coke drum and supportingly connected to the center plate by a strut, wherein the interaction between the strut and the retaining clip keeps the coke drum centered in the support structure and prevents rotation of the coke drum.

21. The coke drum skirt of claim 20, further comprising a series of matching and engaging pads, struts, and retaining clips completely encircling the coke drum.

22. The coke drum skirt of claim 15, wherein the upper plate is a single plate that completely encircles the coke drum.

23. A coke drum skirt that provides a secure connection between a coke drum and a support base while simultaneously providing for reduced-stress thermal expansion and contraction of the coke drum comprising:

a coke drum;

a support structure for the coke drum attached to a support base, the support structure providing a secure fixed connection to the support base and substantially encircling the coke drum;

a substantially-horizontal center plate attached to the coke drum near a junction in the coke drum between a substantially-cylindrical upper portion and a substantially-conical lower portion, the center plate having an upper surface having a low coefficient of friction and a lower surface having a low coefficient of friction, and the center plate completely encircling the coke drum, the center plate further comprising:

a series of pads attached to the coke drum; and a series of struts providing support from the center plate to the pads;

a lower plate having a substantially-horizontal upper surface having a low coefficient of friction, the lower plate being attached to the support structure and completely encircling the coke drum, the lower plate having an inner diameter smaller than the outer diameter of the center plate when the center plate is at the lowest temperature normally reached by the center plate, wherein the upper surface of the lower plate serves as a resting surface for the center plate;

a spacer attached to the upper surface of the lower plate, the spacer completely encircling the coke drum and having an inner diameter greater than the outer diameter of the center plate when the center plate is at the highest temperature normally reached by the center plate in operation of the coke drum; and a series of retaining clips having a substantially-horizontal lower surface having a low coefficient of friction, the retaining clips being attached to the spacer, wherein the retaining clips extend over the center plate a distance greater than the outer diameter of the center plate when the center plate is at the lowest temperature normally reached by the center plate, and wherein the lower surface of the retaining clips retains the center plate under the retaining clips;

wherein the center plate is located in the space defined between the upper surface of the lower plate and the lower surface of the retaining clips so as to slidingly engage the lower plate and retaining clips so that as the coke drum thermally expands and contracts the center plate is always at least partially contained between the lower plate and the retaining clips.

24. The coke drum skirt of claim 23 wherein the retaining clips engage and interact with the struts to keep the coke drum at the center of the support structure and to prevent rotation of the coke drum.

* * * * *